US008590172B2

(12) United States Patent
Ahn et al.

(10) Patent No.: US 8,590,172 B2
(45) Date of Patent: Nov. 26, 2013

(54) DEHUMIDIFYING APPARATUS FOR DRYER

(75) Inventors: Seung-Phyo Ahn, Gyeongsangnam-Do (KR); Sang-Ik Lee, Gyeongsangnam-Do (KR); Byeong-Jo Ryoo, Gyeongsangnam-Do (KR); Sung-Ho Song, Gyeongsanggnam-Do (KR); Jeong-Yun Kim, Gyeongsangnam-Do (KR); Yang-Hwan Kim, Gyeongsangnam-Do (KR); Jae-Hyuk Wee, Gyeongsangnam-Do (KR); Dong-Hyun Kim, Gyeongsangnam-Do (KR); Yoon-Seob Eom, Gyeongsangnam-Do (KR); Yang-Ho Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 541 days.

(21) Appl. No.: 12/676,248

(22) PCT Filed: Sep. 3, 2008

(86) PCT No.: PCT/KR2008/005183

§ 371 (c)(1),
(2), (4) Date: Mar. 3, 2010

(87) PCT Pub. No.: WO2009/031811

PCT Pub. Date: Mar. 12, 2009

(65) Prior Publication Data

US 2010/0199511 A1 Aug. 12, 2010

(30) Foreign Application Priority Data

Sep. 4, 2007 (KR) ..... 10-2007-0089678

(51) Int. Cl.
*F26B 25/06* (2006.01)

(52) U.S. Cl.
USPC ..... 34/73; 34/595; 34/606; 68/5 R; 68/20; 8/137

(58) Field of Classification Search
USPC ..... 34/73, 202, 218, 595, 601, 606; 68/3 C, 68/5 R, 19, 20; 8/137, 159
See application file for complete search history.

(56) References Cited

U.S. PATENT DOCUMENTS 2,958,954 A 11/1960 Longenecker
3,050,867 A 8/1962 Friedman ..... 34/86

(Continued)

FOREIGN PATENT DOCUMENTS

EP 1 820 893 A1 8/2007
JP 02-255198 10/1990

(Continued)

OTHER PUBLICATIONS

Chinese Office Action dated Jul. 20, 2011. (Application No. 200880105483.4).

(Continued)

*Primary Examiner* — Steve M Gravini
(74) *Attorney, Agent, or Firm* — KED & Associates LLP

(57) ABSTRACT

A dehumidifying apparatus is provided for a dryer, the dryer including a case; a drum disposed inside the case that receives objects to be dried therein; and a hot air supplying device that supplies hot air into the drum and dry the objects to be dried. The dehumidifying apparatus includes a plurality of dehumidifying devices, and is thereby capable of controlling humidity of exhausted air to a required level of humidity by removing moisture contained in air exhausted from the plurality of dehumidifying devices in multiple steps.

20 Claims, 5 Drawing Sheets

(56) References Cited

U.S. PATENT DOCUMENTS

| | | | | | |
|---|---|---|---|---|---|
| 3,771,238 | A | * | 11/1973 | Vaughn | 34/86 |
| 4,067,382 | A | * | 1/1978 | English | 165/280 |
| 4,100,964 | A | | 7/1978 | Gorchev et al. | |
| 4,103,433 | A | | 8/1978 | Taylor | |
| 4,163,469 | A | * | 8/1979 | English | 165/297 |
| 4,412,391 | A | * | 11/1983 | Bolognino | 34/90 |
| 4,572,429 | A | * | 2/1986 | Huffman et al. | 237/2 B |
| 4,689,896 | A | | 9/1987 | Narang | |
| 4,967,830 | A | * | 11/1990 | Eubank et al. | 165/48.1 |
| 5,142,873 | A | * | 9/1992 | Ramsey, Jr. | 62/617 |
| 5,226,203 | A | | 7/1993 | Sacconato et al. | |
| 6,151,795 | A | | 11/2000 | Hoffman et al. | |
| 6,474,086 | B1 | | 11/2002 | Liu | |
| 6,887,125 | B2 | | 5/2005 | Kurogouchi | |
| 7,409,776 | B2 | | 8/2008 | Ono et al. | |
| 7,895,770 | B2 | | 3/2011 | Bae et al. | |
| 7,908,766 | B2 | * | 3/2011 | Ahn et al. | 34/595 |
| 7,930,838 | B2 | | 4/2011 | Bae et al. | |
| 7,987,616 | B2 | | 8/2011 | Bae et al. | |
| 7,992,322 | B2 | * | 8/2011 | Kim | 34/595 |
| 7,997,006 | B2 | | 8/2011 | Son et al. | |
| 8,042,283 | B2 | | 10/2011 | Nakiri | |
| 8,250,777 | B2 | | 8/2012 | Kim et al. | |
| 2005/0198852 | A1 | | 9/2005 | Ono et al. | |
| 2005/0204755 | A1 | | 9/2005 | Nishiwaki et al. | |
| 2007/0113421 | A1 | | 5/2007 | Uhara et al. | |
| 2008/0307667 | A1 | | 12/2008 | Ikemizu | |
| 2009/0094852 | A1 | | 4/2009 | Tatsumi et al. | |
| 2009/0282696 | A1 | | 11/2009 | Kim et al. | |
| 2010/0058605 | A1 | | 3/2010 | Kang | |

FOREIGN PATENT DOCUMENTS

| | | | | | |
|---|---|---|---|---|---|
| JP | 08229297 | | * | 9/1996 | D06F 58/02 |
| JP | 2005-27768 | A | | 2/2005 | |
| JP | 2006-181219 | A | | 7/2006 | |
| KR | 20-1991-0011654 | U | | 7/1991 | |
| KR | 10-1993-0013344 | | | 7/1993 | |
| KR | 2001-0096997 | | | 11/2001 | |
| KR | 2002-0058113 | | | 7/2002 | |
| KR | 10-2002-0085831 | A | | 11/2002 | |
| KR | 2003-0024319 | | | 3/2003 | |
| KR | 2003-0079093 | | | 10/2003 | |
| KR | 10-2004-0077338 | A | | 9/2004 | |
| KR | 10-0511966 | B1 | | 9/2005 | |
| KR | 10-2006-0038796 | | | 5/2006 | |
| KR | 10-2006-0063401 | | | 6/2006 | |
| KR | 10-0598383 | B1 | | 7/2006 | |
| KR | 10-2006-0091375 | | | 8/2006 | |
| KR | 10-0829125 | B1 | | 5/2008 | |
| WO | WO 2009031810 | A1 | * | 3/2009 | D06F 58/20 |
| WO | WO 2009031811 | A2 | * | 3/2009 | D06F 58/20 |

OTHER PUBLICATIONS

Australian Office Action dated Nov. 10, 2010 issued in Application No. 2008295742.

International Search Report dated Feb. 4, 2009 issued in Application No. PCT/KR2008/005182.

International Search Report dated Feb. 25 2009 issued in Application No. PCT/KR2008/005184.

U.S. Office Action issued in U.S. Appl. No. 12/676,228 dated Oct. 10, 2012.

U.S. Office Action issued in U.S. Appl. No. 12/676,269 dated Jan. 14, 2013.

* cited by examiner

DEHUMIDIFYING APPARATUS FOR DRYER

TECHNICAL FIELD

The present invention relates to a dryer, and more particularly, to a dehumidifying apparatus for a dryer.

BACKGROUND ART

In general, a clothes dryer is a device that absorbs moisture from objects to be dried (load) by blowing hot air generated by a heater into a drum and thereby dries the load. Clothes dryers may be roughly categorized into an exhaust type clothes dryer and a condensation type clothes dryer, according to the method employed for handling the humid air occurring when absorbing the moisture and drying the load.

The exhaust type clothes dryer employs a method for exhausting the humid air flowing from the drum to the outside of the dryer. However, it requires an exhaust duct for exhausting the moisture evaporated in the drum to the outside. In particular, when gas heating is employed, the exhaust duct needs to be installed being extended long enough to the outdoors, considering that carbon monoxide, etc. as a product of combustion are also exhausted.

Meanwhile, the condensation type clothes dryer uses a recirculation method that removes moisture by condensing the moisture from the humid air flowing from the drum in a heat exchanger and then re-circulates the moisture-removed dry air back into the drum. However, the drying air flow forms a closed loop, making it difficult to use gas as a heating source.

A ductless dryer overcomes the demerits of the exhaust type dryer and the condensation type dryer. That is, the ductless dryer can be maintained at a low cost by using gas as the heating source and does not require an additional exhaust duct to be extended to the outdoors.

Meanwhile, the heat exchanger in the conventional condensation type clothes dryer is generally an air-cooled heat exchanger, thereby being unable to fully condense moisture contained in gas supplied from the drum up to a required level. Accordingly, the moisture would be introduced back into the drum through the heat exchanger or be greatly contained in gas exhausted to the outside.

DISCLOSURE OF INVENTION

Technical Problem

Therefore, an object of the present invention is to provide a dehumidifying apparatus for a dryer having a structure which enables temperature-humidity of gas introduced from a drum to closely reach a required level.

Technical Solution

According to one aspect of the present invention, there is provided a dehumidifying apparatus for a dryer comprising: a case; a drum disposed inside the case and for receiving objects to be dried therein; and a hot air supplying unit for supplying hot air into the drum and drying the objects to be dried, the dehumidifying apparatus, comprising: a plurality of dehumidifying units.

Here, the plurality of dehumidifying units may include a first dehumidifying unit for removing moisture from air directly flowing from the drum; and a second dehumidifying unit for removing moisture again from the air flowing from the first dehumidifying unit.

In the dehumidifying apparatus for a dryer according to one aspect of the present invention, moisture contained in air exhausted by the plurality of dehumidifying units is removed in multiple steps, thereby capable of rapidly and effectively controlling humidity of exhausted air to a required level.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODE FOR THE INVENTION

Description will now be given in detail of the dehumidifying apparatus for a dryer according to the preferred embodiments of the present invention, examples of which are illustrated in the accompanying drawings. Here, the dehumidifying apparatus for a dryer is not limited to a ductless dryer which discharge the dehumidified air to the outside of the body, but may also be applied to various types of dryers, such as a general condensation type or circulation type dryer, and the like.

Figure 1:
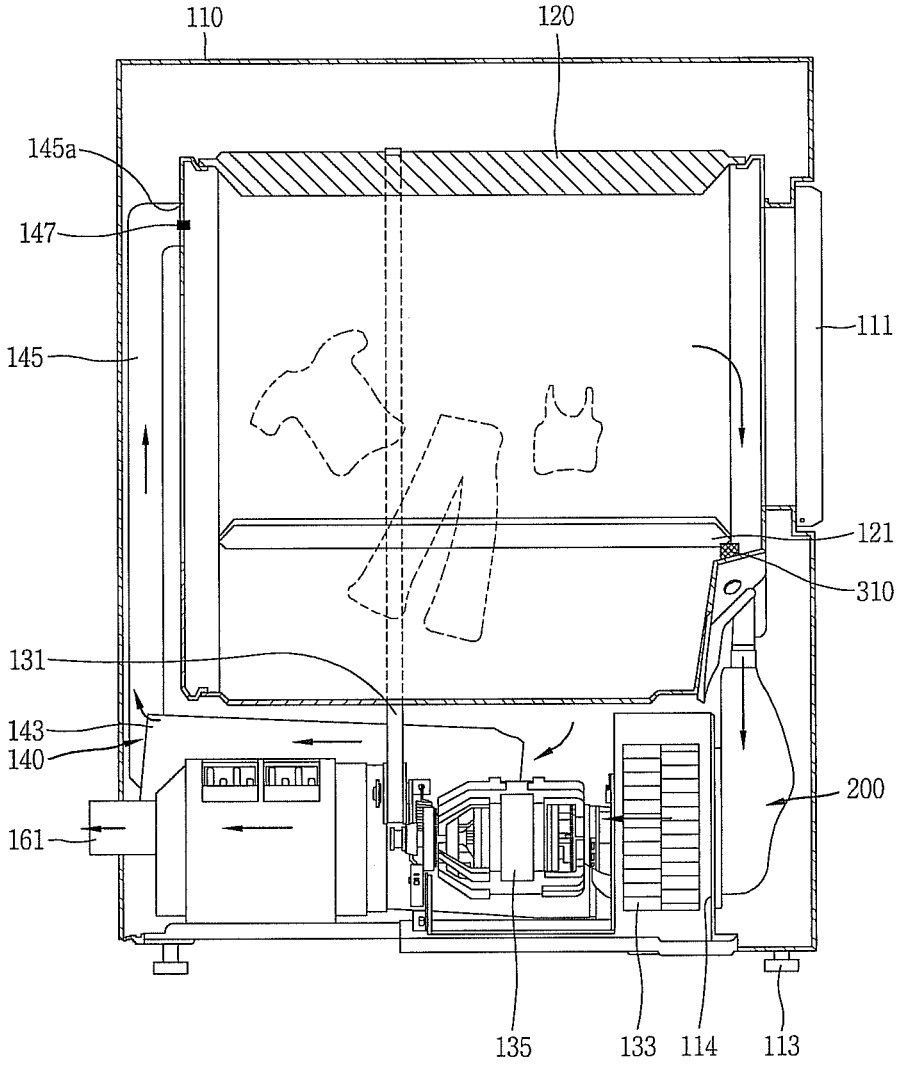
FIG. 1 is a schematic view of a dryer to which a dehumidifying apparatus is employed according to a first embodiment of the present invention.
Figure 2:
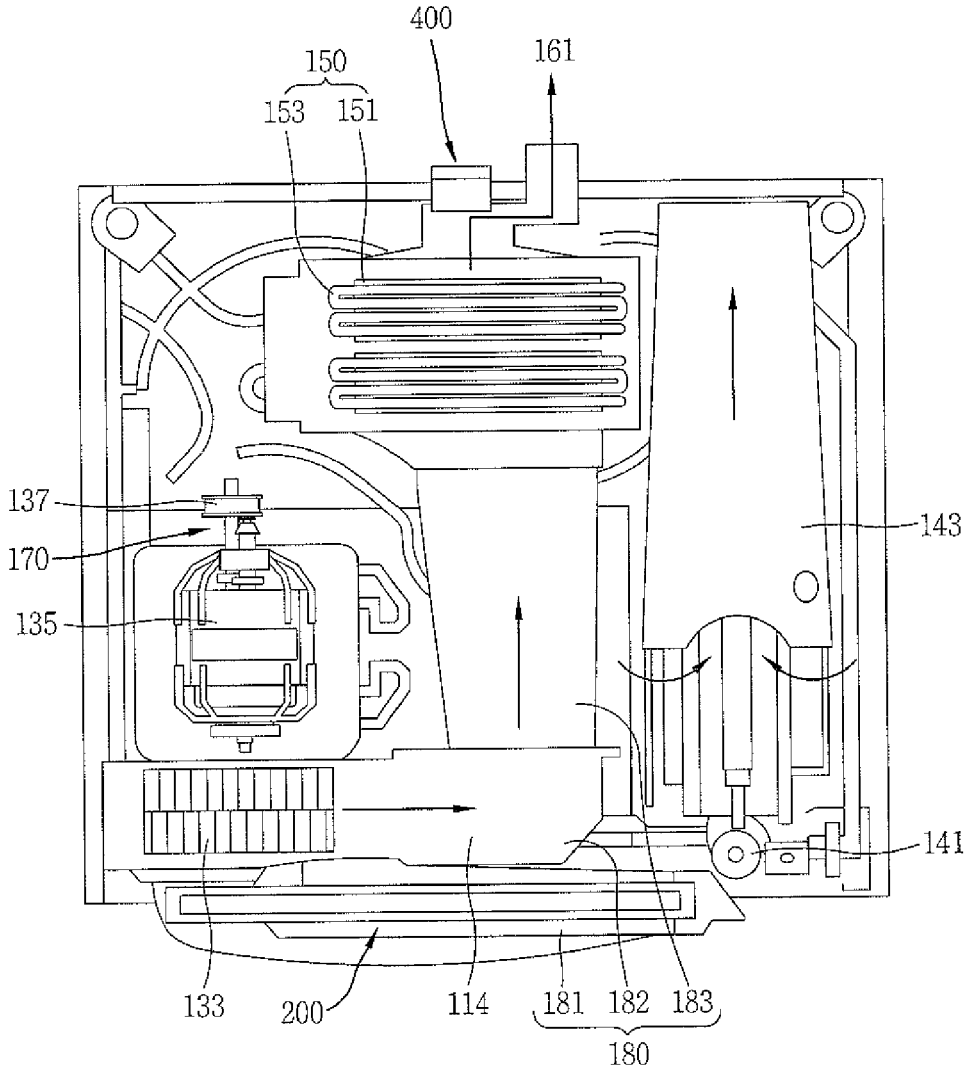
FIG. 2 is a plane view of the dryer to which the dehumidifying apparatus is employed according to the first embodiment of the present invention.

FIG. 1 is a schematic view of a dryer to which a dehumidifying apparatus is employed according to a first embodiment of the present invention. FIG. 2 is a plane view of the dryer to which the dehumidifying apparatus is employed according to the first embodiment of the present invention. Arrows indicate the flow of air.

Referring to FIGS. 1 and 2, the ductless dryer according to a first embodiment of the present invention may include a main body 110; a drum 120 rotatably mounted at the main body 110; a hot air supplying unit 140 supplying hot air into the drum 120; a heat exchanger 150 removing moisture contained in the air exhausted from the drum 120; a circulation duct 180 conducting the air exhausted from the drum 120 to the heat exchanger 150; a filter 200 installed in the circulation duct 180 and filtering lint contained in the air coming out of the drum 120; and a sealing unit S preventing the leakage of lint through a gap of an installation portion where the filter 200 is installed.

A door 111 is mounted on a front surface of the main body 110 to enable loading of clothes into the drum 120. A foot 113 is disposed at a lower portion of the main body 110 to support the main body 110. A belt 131 for rotating the drum 120 and a motor 135 for supplying a driving force to the belt 131 are mounted inside the main body 110. A pulley 137 for winding the belt 131 is disposed on a shaft of the motor 135.

The drum 120 is a container having an inner space into which clothes, etc., as objects to be dried, can be loaded. A plurality of lifters 121 are installed inside the drum 120 so as to lift the clothes.

The hot air supplying unit 140 includes a valve 141 controlling the supplying of gas, a gas burner 143 mixing the gas supplied from the valve 141 with an air supplied from the outside, igniting it, and then generating hot air, and a hot air supplying duct 145 communicating the gas burner 143 with the drum 120 so as to supply the generated hot air to the drum 120. In order to indirectly determine the amount of carbon monoxide (CO) emissions through a numerical value of a flame current by detecting the flame current, a flame rod extending to an edge of a flame may be installed in the hot air supplying unit 140.

Preferably, the valve 141 is implemented as a solenoid valve so as to sensitively adjust the amount of gas supplied.

While being supplied by the valve 141, the gas burner 143 heats the air with the heat generated when the gas supplied from the valve 141 is mixed with the outside air and then burned. The hot air generated by being thusly heated is provided to the drum 120 through the hot air supplying duct 145.

The heat exchanger 150 includes fins 151 and a tube 153. The heat exchanger 150 condenses moisture from the air of high temperature and humidity coming out of the drum 120 through a heat exchange method of air to water by using water of low temperature, to thereby dry the air. An inlet of the heat exchanger 150 is connected to the drum 120 by the circulation duct 180, and an outlet thereof is connected to an exhaust duct 161. That is, the air discharged to the outside through the exhaust duct 161 via the heat exchanger 150.

The heat exchanger 150 is an example of a first dehumidifying unit for removing moisture by condensing gas flowing from the drum 120. Other types of a means capable of cooling exhausted air of high temperature and humidity for condensation or directly removing moisture contained in air may also be employed.

The fins 151 are thin metallic plates having excellent thermal conductivity and are laminated as a plurality of thin vertical metallic plates having a minute distance therebetween so as to contact the air of high temperature and humidity as it passes through.

Water of low temperature (22° C.) is circulated through the tube 153. The tube 153 penetrates the fins 151 in a serpentine manner. Both ends of the tube 153 are connected to water lines (not shown) for supplying and draining water of low temperature. A water container (not shown) for collecting condensed water, which is generated during the condensation process and dropped, is installed at a lower portion of the heat exchanger 150.

The circulation duct 180 includes a filter installation duct 181 providing a space where the filter 200 is installed, a fan installation duct 182 connected to the filter installation duct 181 and providing a space where the fan 133 is installed, and a connection duct 183 for connecting the fan installation duct 182 and the heat exchanger 150. Here, the fan 133 is connected to a shaft of the motor 135 and is supplied a driving force from the motor 135. To be certain, a plurality of motors 135 may be provided so as to respectively supply a driving force to the belt 131 and the fan 133.

Figure 3:
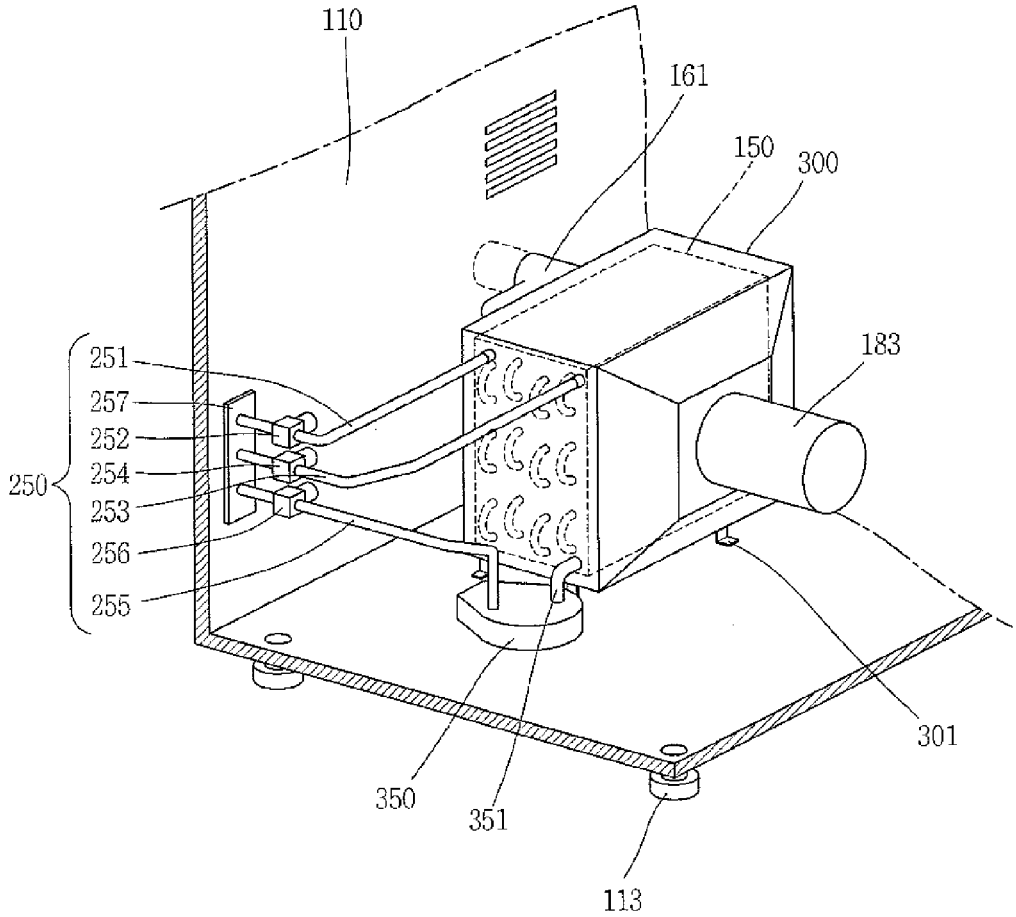
FIG. 3 is a perspective view of the dehumidifying apparatus for the dryer according to the first embodiment of the present invention.
Figure 4:
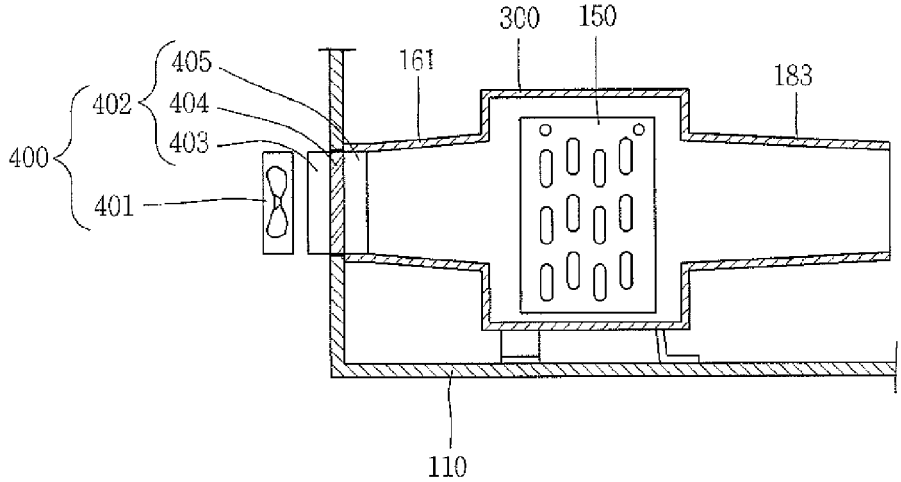
FIG. 4 is a schematic cross-sectional view of the dehumidifying apparatus for the dryer according to the first embodiment of the present invention.
Figure 5:
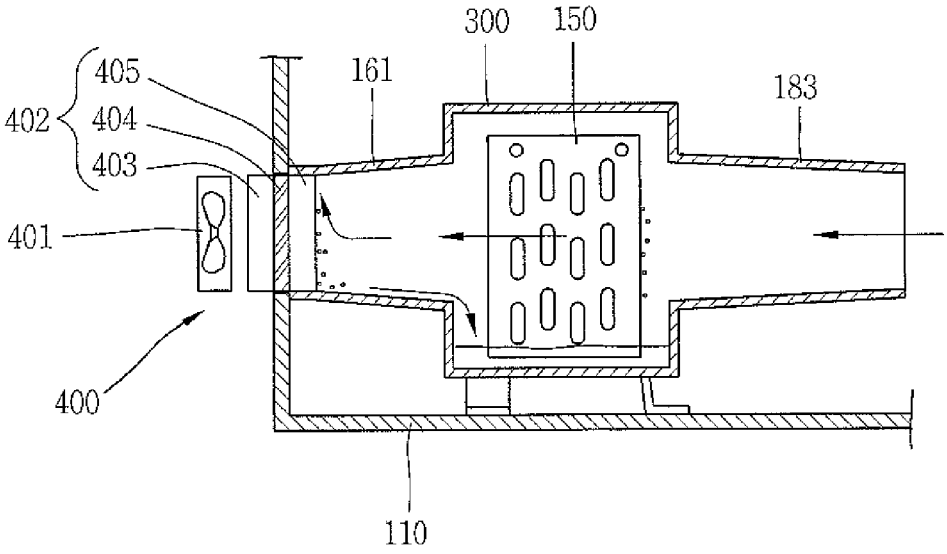
FIG. 5 is a schematic cross-sectional view showing that the dehumidifying apparatus for a dryer is operated according to the first embodiment of the present invention.

FIG. 3 is a perspective view of the dehumidifying apparatus for the dryer according to the first embodiment of the present invention. FIG. 4 is a schematic cross-sectional view of the dehumidifying apparatus for the dryer according to the first embodiment of the present invention. FIG. 5 is a schematic cross-sectional view showing that the dehumidifying apparatus for a dryer is operated according to the first embodiment of the present invention.

Referring to FIGS. 3 through 5, the heat exchanger 150 and a condenser case 300 for covering the heat exchanger 150 are formed at a lower surface of the dryer main body 110 according to this embodiment. The connection duct 183 is communicated with one side of the condenser case 300, and the exhaust duct 161 is communicated with another side thereof.

The heat exchanger 150 is installed inside the condenser case 300 which entirely covers the heat exchanger 150. The condenser case 300 may be tightly sealed so as to maintain its sealed state.

A refrigerant flowing through the tube 153 is heat-exchanged with air introduced from the drum 120 through the connection duct 183 in the heat exchanger 150. Water may be used as such refrigerant. During the heat exchange, the moisture contained in the air is condensed, thereby generating condensate water. The condensate water flows along the heat exchanger 150, and is directed to the lower portion of the condenser case 300.

The lower portion of the condenser case 300 serves as a container (water tank) for containing the condensate water flowing down from the heat exchanger 150. A lowermost water tank 350 is disposed at one side of the condenser case 300 so as to be communicated with the lower portion of the condenser case 300 (i.e., the water tank) by a communication pipe 351.

The lowermost water tank 350 is disposed at a relatively lower position than the water tank (i.e., the lower portion of the condenser case 300). Accordingly, the condensate water contained in the lower portion of the condenser case 300 may be introduced to the lowermost water tank 350.

The lowermost water tank 350 is connected to a condensate water outlet pipe 255. The lowermost water tank 350 may further include a pump. Then, the condensate water received in the lowermost water tank 350 by the pump may be drained to the outside through the condensate water outlet pipe 255.

Meanwhile, the condensate water outlet pipe 255, a refrigerant inlet pipe 251, a refrigerant outlet pipe 253, and a pipe coupling plate 257 may form to be one assembly for modularization. Such module is implemented as a pipe module 250 as shown in FIG. 3. The modularization of the pipes facilitates installation and removal processes of the pipes.

Here, the refrigerant inlet pipe 251 is a path (passage) through which a refrigerant (e.g., water) is introduced to the heat exchanger 150 from the outside. The refrigerant outlet pipe 253 is a path (passage) through which the refrigerant flowing from the heat exchanger 150 is discharged to the outside.

Reference numerals 252, 254 and 256 denote control valves for each pipe. The control valve is implemented as a solenoid valve.

In this embodiment, based on a direction of gas flow from the heat exchanger 150, an air-cooled heat exchange module 400 as a second dehumidifying unit is installed at a rear side of the heat exchanger 150. The air-cooled heat exchange module 400 may be disposed on the exhaust duct 161. A cooling side of the air-cooled heat exchange module 400 is disposed to face a channel through which gas flowing from the heat exchanger 150 passes.

In order to improve operation efficiency of the air-cooled heat exchange module 400, it is preferable that a channel of the exhaust duct 161 is bent (FIG. 2) and the air-cooled heat exchange module 400 is disposed at the bent channel such that gas flowing inside the exhaust duct 161 easily contact the air-cooled heat exchange module 400. Such air-cooled heat exchange module 400 re-condenses the gas flowing from the heat exchanger 150 so as to control the gas humidity to be relatively closer to a required (desired) level of humidity.

The air-cooled heat exchange module 400 is comprised of a fan 401 and a heat sink 402. The heat sink 402 includes a heat radiation fin 403, a heat exchange plate 404 and a heat absorption fin 405.

Description of the air-cooled heat exchange module 400 with such configuration is given as follows. As shown in FIG. 5, gas introduced from the drum 120 is primarily condensed when passing through the heat exchanger 150. Condensate water generated is received in the lower water tank of the condenser case 300.

The gas flowing from the heat exchanger 150 is introduced into the exhaust duct 161. The introduced gas is then heat-exchanged with the air-cooled heat exchange module 400 formed on a wall of one side of the exhaust duct 161.

More specifically, the heat absorption fin 405 absorbs heat of the gas, and the absorbed heat is transferred to the heat radiation fin 403 through the heat exchange plate 404. Such heat may be exhausted to the outside through the open air supplied to the heat radiation fin 403 by the fan 401.

That is, humidity of gas has primarily been controlled by being heat-exchanged while passing the heat exchanger 150 as a temperature-humidity controller. Then, the humidity of the gas is controlled again by being heat-exchanged with the air-cooled heat exchange module 400. Therefore, the humidity of gas may be controlled to be relatively closer to the required level of humidity.

Meanwhile, the condensate water generating when heat is exchanged between the air-cooled heat exchange module 400 and gas flows along the exhaust duct 161, thus to be contained in the lower water tank of the condenser case 300.

Hereinafter, another embodiment of the present invention will be described in detail. Same explanations as those given in the first embodiment of the present invention are omitted.

Figure 6:
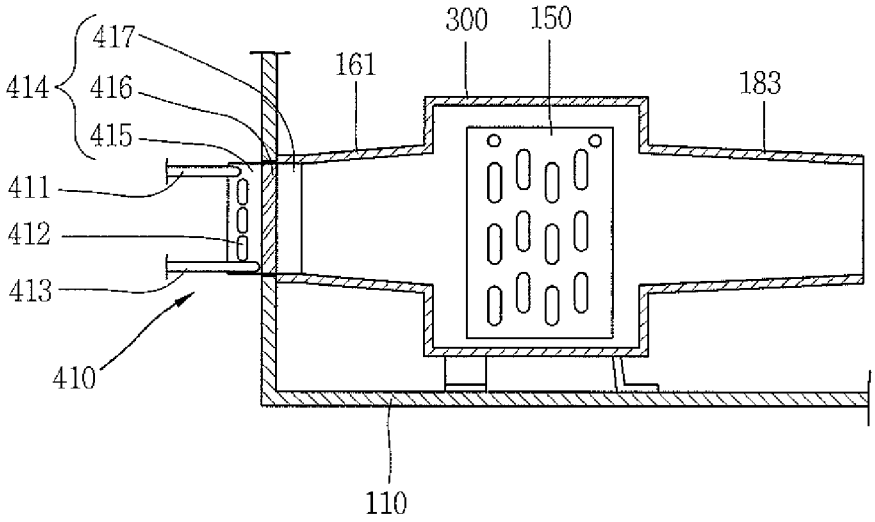
FIG. 6 is a schematic cross-sectional view of a dehumidifying apparatus for a dryer according to a second embodiment of the present invention.

FIG. 6 is a schematic cross-sectional view of a dehumidifying apparatus for a dryer according to a second embodiment of the present invention.

Referring to FIG. 6, a water-cooled heat exchange module 410 as a second dehumidifying unit is installed at a rear side of the heat exchanger 150.

The water-cooled heat exchange module 410 may include a water supply pipe 411, a heat exchange pipe 412, a water drain pipe 413, a heat radiation fin 415, a heat exchange plate 416 and a heat absorption plate 417. That is, the fan and the heat radiation fin in FIG. 5 are replaced with a water-cooled water jacket in the embodiment shown in FIG. 6.

Cool water introduced into the water supply pipe 411 is configured to cool the heat radiation fin 415 while flowing through the heat exchange pipe 412, and after the heat exchange, to be discharged to the outside through the water drain pipe 413.

The water supply pipe 411 for supplying water may be separately formed from the refrigerant inlet pipe 251, or integrally formed with the refrigerant inlet pipe 251. The humidity of gas may be re-adjusted while being heat-exchanged with the water-cooled heat exchange module 410.

Figure 7:
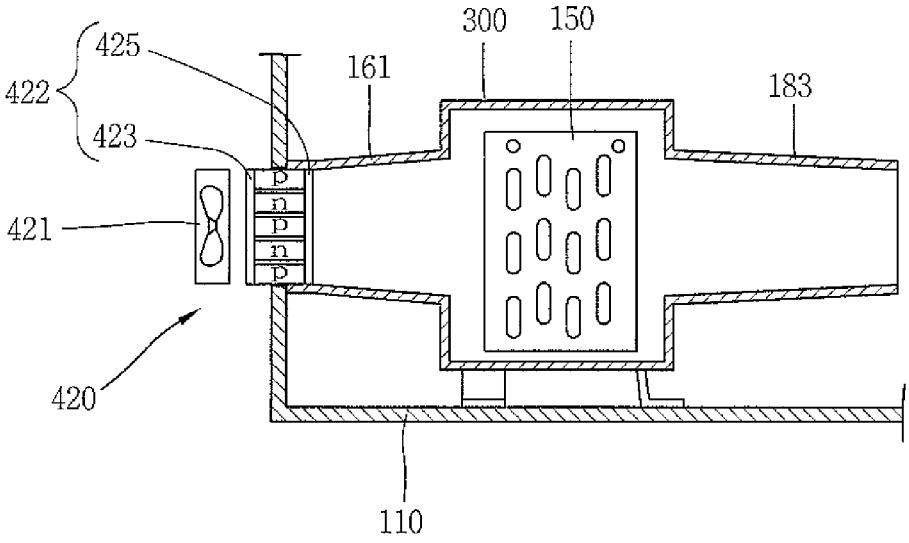
FIG. 7 is a schematic cross-sectional view of a dehumidifying apparatus for a dryer according to a third embodiment of the present invention.

FIG. 7 is a schematic cross-sectional view of a dehumidifying apparatus for a dryer according to a third embodiment of the present invention.

Referring to FIG. 7, a thermoelectric module 420 as a second dehumidifying unit is installed at a rear side of the heat exchanger 150. The thermoelectric module 420 may include a thermoelectric element 422 and a fan 421. A heat absorption side of the thermoelectric element is disposed inside the exhaust duct 161, and a heat radiation side thereof is disposed outside the exhaust duct 161.

If gas flowing through the exhaust duct 161 is cooled by contacting the heat absorption side of the thermoelectric element 422, moisture remaining in the gas is saturated, thereby being condensate water. An outer plate 423 of the thermoelectric element 422 which radiates by the heat exchange is cooled by the fan 421.

Figure 8:
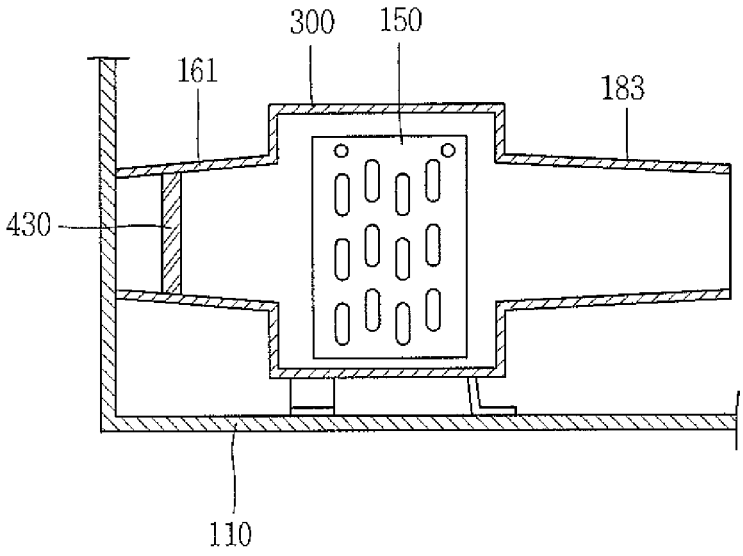
FIG. 8 is a schematic cross-sectional view of a dehumidifying apparatus for a dryer according to a fourth embodiment of the present invention.

FIG. 8 is a schematic cross-sectional view of a dehumidifying apparatus for a dryer according to a fourth embodiment of the present invention.

Referring to FIG. 8, a desiccant 430 as a second dehumidifying unit is installed at a rear side of the heat exchanger 150. The desiccant 430 is disposed on a channel through which gas flowing from the heat exchanger 150 passes.

With such configuration, gas primarily dehumidified while flowing from the heat exchanger 150 may be secondarily dehumidified while passing through the desiccant 430.

Such second dehumidifying units described in the above embodiments may be used in various combinations thereof. For instance, both the air-cooled heat exchange module 400 and the desiccant 430 may be used together.

According to the dehumidifying apparatus for a dryer in one aspect of the present invention, humidity of gas has primarily been controlled by being heat-exchanged when gas passes through the heat exchanger serving as the first dehumidifying unit, and then is secondarily controlled when the gas passes through the second dehumidifying unit. Therefore, it has an effect of controlling the humidity of gas to be relatively closer to the required level of humidity.

The above embodiments have described a case having two dehumidifying units, however, it is not meant to limiting the number of the dehumidifying units. A plurality of dehumidifying units may be provided in consideration of dryer capacity, and the like.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. A dryer, comprising:

a case;

a drum disposed inside the case that receives objects to be dried therein;

a hot air supplying device that supplies hot air into the drum and dries the objects to be dried; and an exhaust duct that discharges the air through a plurality of dehumidifying devices to outside of the case, the plurality of dehumidifying devices comprising:

a first dehumidifying device that removes moisture from air flowing directly from the drum, wherein the first dehumidifying device comprises an inlet and an outlet for the air; and a second dehumidifying device that removes moisture again from the air flowing from the outlet of the first dehumidifying device.

2. The dryer of claim 1, wherein a humidity of air flowing from the second dehumidifying device is relatively closer to a required level of humidity, when compared to a humidity of air flowing from the first dehumidifying device.

3. The dryer of claim 1, wherein the second dehumidifying device includes an air-cooled heat exchange module.

4. The dryer of claim 3, wherein the air-cooled heat exchange module comprises:

a heat sink that heat exchanges with the air; and a fan disposed at one side of the heat sink.

5. The dryer of claim 4, wherein the heat sink comprises:

a heat absorption fin to heat exchange with the air;

a heat radiation fin to heat exchange with open air; and a heat exchange plate disposed between the heat absorption fin and the heat radiation fin, wherein the fan is disposed to blow the open air toward the heat radiation fin.

6. The dryer of claim 1, wherein the second dehumidifying device includes a water-cooled heat exchange module.

7. The dryer of claim 6, wherein the first dehumidifying device includes a water-cooled heat exchange module, and wherein channels to supply cool water, respectively, to the first and second dehumidifying devices are independent from each other.

8. The dryer of claim 6, wherein the first dehumidifying device includes a water-cooled heat exchange module, and wherein a cool water supply channel to the second dehumidifying device is diverged from a cool water supply channel to the first dehumidifying device.

9. The dryer of claim 1, wherein the second dehumidifying device includes a thermoelectric module.

10. The dryer of claim 9, wherein the thermoelectric module comprises:

a thermoelectric element having a heat absorption side thereof that heat exchanges with air flowing from the first dehumidifying device, and having a heat radiation side thereof that heat exchanges with open air; and a fan that blows the open air to the heat radiation side of the thermoelectric element.

11. The dryer of claim 1, wherein the second dehumidifying device includes a device that directly removes moisture contained in air flowing from the first dehumidifying device.

12. The dryer of claim 11, wherein the device that removes the moisture includes a desiccant.

13. The dryer of claim 1, further comprising:

a duct that connects the outlet of the first dehumidifying device and an inlet of the second dehumidifying device.

14. The dryer of claim 13, wherein the duct includes at least one bent part, and the second dehumidifying device is disposed adjacent to the bent part.

15. The dryer of claim 1, wherein the water-cooled heat exchange module comprises:

a heat absorption plate to that heat exchanges with air;

a water-cooled water jacket; and a heat exchange plate disposed between the heat absorption plate and the water-cooled water jacket.

16. The dryer of claim 15, wherein the water-cooled water jacket comprises:

a heat exchange pipe;

a water supply pipe that supplies water to the heat exchange pipe; and a water drain pipe the drains water from the water supply pipe.

17. The dryer of claim 1, further comprising a hot air supply duct that supplies the hot air from the hot air supply device to the drum.

18. The dryer of claim 1, further comprising a filter disposed in a circulation duct upstream of the first and second dehumidifying devices.

19. The dryer of claim 1, further comprising a fan disposed in a circulation duct upstream of the first and second dehumidifying devices.

20. The dryer of claim 1, further comprising;

a pipe module through which a refrigerant is supplied to and drained from the first dehumidifying device.

* * * * *